US011808447B2

(12) United States Patent
Caloca et al.

(10) Patent No.: US 11,808,447 B2
(45) Date of Patent: Nov. 7, 2023

(54) BURNER BASE

(71) Applicant: WHIRLPOOL CORPORATION, Benton Harbor, MI (US)

(72) Inventors: Victor Gerardo Caloca, Guanajuato (MX); Tao Geng, St. Joseph, MI (US); Victor Manrique, St. Joseph, MI (US); Ana Katia Silva, Guanajuato (MX)

(73) Assignee: Whirlpool Corporation, Benton Harbor, MI (US)

( * ) Notice: Subject to any disclaimer, the term of this patent is extended or adjusted under 35 U.S.C. 154(b) by 656 days.

(21) Appl. No.: 16/726,397

(22) Filed: Dec. 24, 2019

(65) Prior Publication Data

US 2020/0132297 A1 Apr. 30, 2020

Related U.S. Application Data

(63) Continuation of application No. 15/440,774, filed on Feb. 23, 2017, now Pat. No. 10,551,056.

(51) Int. Cl.
*F23D 14/06* (2006.01)

(52) U.S. Cl.
CPC ..... *F23D 14/06* (2013.01); *F23D 2203/00* (2013.01)

(58) Field of Classification Search
CPC ..... F23D 14/02; F23D 14/74; F23D 14/70; F23D 14/46; F23D 14/06; F24C 3/08; F24C 3/082
USPC ..... 431/278, 343, 354; 126/39 E, 39 R
See application file for complete search history.

(56) References Cited

U.S. PATENT DOCUMENTS

| | | | | |
|---|---|---|---|---|
| 3,289,731 | A | 12/1966 | Geber | |
| 3,301,311 | A * | 1/1967 | Stohrer, Jr. | F23D 14/04 239/567 |
| 3,606,612 | A | 9/1971 | Reid, Jr. | |
| 4,518,346 | A | 5/1985 | Pistien | |
| 4,565,523 | A | 1/1986 | Berkelder | |
| 5,083,915 | A | 1/1992 | Riehl | |
| 5,112,218 | A | 5/1992 | Sigler | |
| 5,152,276 | A | 10/1992 | Brock et al. | |
| 5,160,256 | A | 11/1992 | Riehl | |
| 5,266,026 | A | 11/1993 | Riehl | |
| 5,328,357 | A | 7/1994 | Riehl | |

(Continued)

FOREIGN PATENT DOCUMENTS

CN 205316325 U * 6/2016

*Primary Examiner* — Edelmira Bosques
*Assistant Examiner* — Deepak A Deean
(74) *Attorney, Agent, or Firm* — Price Heneveld LLP

(57) ABSTRACT

A burner base for a stacked burner assembly to secure a uniform distribution of gas flow. The burner base couples with a top burner cover and together define an internal gas mixture chamber. The burner base includes a barrier structure along a perimeter having a plurality of structural zones. A first structural zone includes a semi-circular barrier structure having a height that is taller at a middle portion than at the end portions. A second structural zone includes an arc structure having a height that is taller than the heights of adjacent structural zone heights. A third structural zone includes a semi-circular structure having a consistent height along the structure. A fourth structural zone includes a non-raised semi-circular structure. The barrier structure is configured to facilitate the distribution of the gas within the mixture chamber.

13 Claims, 10 Drawing Sheets

(56) References Cited

U.S. PATENT DOCUMENTS 5,397,234 A 3/1995 Kwiatek
5,649,822 A 7/1997 Gertler et al.
5,961,311 A 10/1999 Moore, Jr.
6,035,846 A 3/2000 Saleri
6,067,978 A * 5/2000 Schlosser ..... F23D 14/06 126/41 R
6,244,263 B1 * 6/2001 Schlosser ..... A47J 37/0713 126/41 R
6,263,868 B1 7/2001 Koch et al.
6,322,354 B1 11/2001 Carbone et al.
6,663,025 B1 12/2003 Halsey et al.
6,679,699 B2 * 1/2004 Yam ..... F23D 14/06 126/39 R
6,712,605 B2 3/2004 Moresco
6,889,685 B2 * 5/2005 Dane ..... F23D 14/06 126/39 B
7,017,572 B2 3/2006 Cadima
7,083,123 B2 8/2006 Molla
7,291,009 B2 * 11/2007 Kamal ..... F24C 3/085 431/278
7,594,812 B2 9/2009 Armanni
7,614,877 B2 11/2009 McCrorey et al.
7,901,205 B2 * 3/2011 Trochou ..... F23D 14/64 431/278
8,206,148 B2 * 6/2012 Paesani ..... F23D 14/065 431/129
8,220,450 B2 * 7/2012 Luo ..... F23D 14/06 431/278
8,408,897 B2 4/2013 Rossi et al.
8,689,779 B2 * 4/2014 Cadeau ..... F23D 14/06 431/284
8,747,108 B2 * 6/2014 Lona Santoyo ..... F23D 14/06 126/39 B
8,753,112 B2 6/2014 Armanni et al.
8,845,326 B2 9/2014 Shaffer et al.
8,899,972 B2 * 12/2014 Fowler ..... F23D 14/62 126/39 H
8,932,049 B2 1/2015 Ryu et al.
9,074,765 B2 * 7/2015 Armanni ..... F23D 23/00
9,416,963 B2 * 8/2016 Armanni ..... F24C 3/08
9,513,012 B2 * 12/2016 Gen ..... F23D 14/06
9,651,247 B2 * 5/2017 Scheuring, III ..... F23D 14/04
9,989,248 B2 * 6/2018 Angulo ..... F23D 14/06
10,352,558 B2 7/2019 Angulo et al.
10,393,386 B2 8/2019 Gasparini et al.
10,393,387 B2 8/2019 Cadima
10,451,287 B2 * 10/2019 Park ..... F24C 3/085
10,502,416 B2 * 12/2019 Breccia ..... F24C 3/085
10,928,061 B2 * 2/2021 Rasi ..... F23L 1/00
11,359,818 B2 * 6/2022 Martin ..... F24C 3/082
2003/0000512 A1 1/2003 Moresco
2003/0075164 A1 * 4/2003 Dane ..... F23D 14/06 126/39 R
2004/0195399 A1 10/2004 Molla
2004/0241604 A1 12/2004 Cadima
2007/0141521 A1 6/2007 Armanni
2008/0241777 A1 10/2008 Rossi et al.
2009/0087804 A1 * 4/2009 Pryor ..... F23D 14/76 431/263
2011/0143295 A1 * 6/2011 Fowler ..... F23D 14/06 431/285
2012/0070791 A1 3/2012 Armanni et al.
2012/0090595 A1 * 4/2012 Shaffer ..... F23N 1/002 126/39 E
2013/0269676 A1 10/2013 Quintaba'et al.
2014/0060517 A1 * 3/2014 Ren ..... F23D 14/64 126/39 E
2014/0090636 A1 4/2014 Bettinzoli
2014/0116417 A1 * 5/2014 Dora ..... F23D 14/065 126/39 E
2015/0107577 A1 4/2015 Jeong et al.
2015/0253012 A1 9/2015 Faveri et al.
2016/0178209 A1 6/2016 Park et al.
2016/0178212 A1 6/2016 Park et al.
2017/0205075 A1 * 7/2017 Cadima ..... F24C 3/082
2017/0205076 A1 * 7/2017 Cadima ..... F24C 15/107
2018/0045406 A1 * 2/2018 Wang ..... F23D 14/64
2018/0073730 A1 3/2018 Acosta Herrero et al.
2018/0073731 A1 * 3/2018 Acosta Herrero ..... F24C 3/08
2018/0112869 A1 * 4/2018 Cadima ..... F24C 15/107
2018/0142898 A1 * 5/2018 Cadima ..... F24C 15/107
2018/0195719 A1 7/2018 Angulo et al.
2018/0238537 A1 8/2018 Caloca et al.
2018/0320903 A1 * 11/2018 Cadima ..... F23D 14/20

* cited by examiner

BURNER BASE

CROSS-REFERENCE TO RELATED APPLICATION

This application is a continuation of U.S. patent application Ser. No. 15/440,774, filed Feb. 23, 2017, now U.S. Pat. No. 10,551,056, entitled "BURNER BASE," which is incorporated hereby by reference in its entirety.

FIELD OF THE DISCLOSURE

The present disclosure generally relates to a burner base having a geometry that contributes to flow distribution within the burner mixture chamber.

SUMMARY OF THE DISCLOSURE

According to one aspect of the present disclosure, a burner base comprises an internal perimeter lip. A perimeter edge defines a barrier lip disposed radially outward of the internal perimeter lip. A bottom surface extends outwardly from the internal perimeter lip toward the barrier lip and a gas inlet being defines in the bottom surface. A first barrier structure is disposed along the perimeter edge adjacent the gas inlet and has a middle section height above the bottom surface that is greater than an end height above the bottom surface. A second barrier structure is circumferentially adjacent to the first barrier structure and defines an arc inwardly directed from the barrier lip toward the internal perimeter lip. A third barrier structure extends circumferentially away from the second barrier structure and defines a constant height along a length of the third barrier structure.

According to another aspect of the present disclosure, a gas mixture chamber for a burner base comprises an internal perimeter lip that is centrally positioned within the gas mixture chamber. An outer perimeter edge is radially outward of the internal perimeter lip. A bottom surface is circumferentially disposed between the internal perimeter lip and an outer perimeter edge and downwardly slopes from the internal perimeter lip toward the outer perimeter edge. A gas inlet is being defined in the bottom surface. A structure zone is circumferentially adjacent to the bottom surface and the outer perimeter edge and extends circumferentially away from the gas inlet. The structural zone is along with the bottom surface, the internal perimeter lip, and the outer perimeter edge promoting a symmetrical flow of gas away from the gas inlet within the gas mixture chamber.

According to another aspect of the present disclosure, a gas mixture chamber for a burner assembly comprises a first barrier structure that is disposed along an outer perimeter of the chamber. A second barrier structure defines a peak that is oriented toward a center of the chamber. The second barrier structure is circumferentially adjacent to the first barrier structure and promotes a symmetrical flow of gas relative to the first barrier structure. A third barrier structure radially extends from the second barrier structure to define a planar surface at a height below the second barrier structure. A fourth barrier structure radially extends from the third barrier structure to define a stepped portion of the third barrier structure. The fourth barrier structure along with the first, second, and third barrier structures promotes a symmetrical flow of gas within the chamber away from an eccentric gas inlet that is positioned within the chamber.

These and other features, advantages, and objects of the present disclosure will be further understood and appreciated by those skilled in the art by reference to the following specification, claims, and appended drawings.

BRIEF DESCRIPTION OF THE DRAWINGS

Further advantages and features according to the present disclosure will become clear from the following detailed description provided as a non-limiting example, with reference to the attached drawings in which.

DETAILED DESCRIPTION

Figure 1:
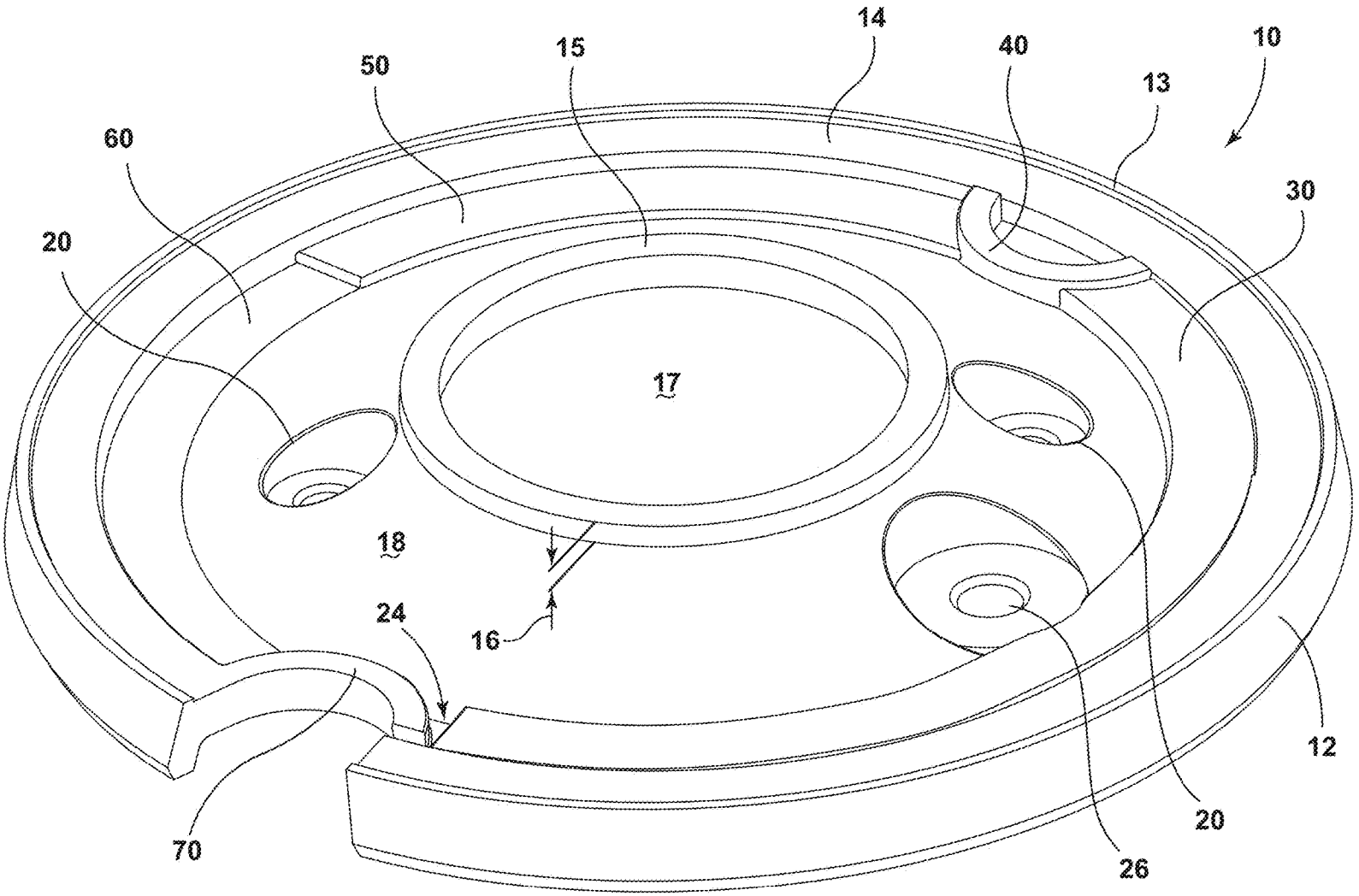
FIG. 1 is a top perspective view of a burner base, according to an embodiment of the present disclosure.

The present illustrated embodiments reside primarily in combinations of apparatus components related to a burner base 10 for a stack burner assembly 110, for use in a cooking appliance, such as cooking appliance 100. Accordingly, the apparatus components have been represented, where appropriate, by conventional symbols in the drawings, showing only those specific details that are pertinent to understanding the embodiments of the present disclosure. Further, like numerals in the description and drawings represent like elements.

It is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. For example, an element proceeded by "comprises a . . . " does not, without more constraints, preclude the existence of additional identical elements in the process, method, article, or apparatus that comprises the element.

For purposes of this disclosure, the term "coupled" (in all of its forms, couple, coupling, coupled, etc.) generally means the joining of two components directly or indirectly to one another. Such joining may be stationary in nature or movable in nature. Such joining may be achieved with the two components and any additional intermediate members being integrally formed as a single unitary body with one another or with the two components. Such joining may be permanent in nature or may be removable or releasable in nature unless otherwise stated.

Referring to the attached FIGS. 1-9B, the present disclosure provides a burner base for a burner assembly 110. As shown in the illustrated embodiment of FIGS. 4 and 5, burner base 10 may be coupled with a burner spreader 80, and, when positioned together, define a gas mixture chamber 112 within burner assembly 110. According to the present disclosure, burner base 10 may include a plurality of structural zones, each structural zone having a unique geometry to enable the distribution of gas around the burner assembly 110 and to facilitate an even flame for the burner. In at least one case, burner base 10 includes a first barrier structure 30 disposed in a first structural zone of a gas mixture chamber 112, a second barrier structure 40 disposed in a second structural zone of the gas mixture chamber 112, a third barrier structure 50 disposed in a third structural zone of the gas mixture chamber 112, and a fourth barrier structure 60 disposed in a fourth structural zone of the gas mixture chamber 112. The burner base 10 as well as other embodiments of gas burner assemblies contemplated herein will be discussed in more detail in the following paragraphs.

Figure 2:
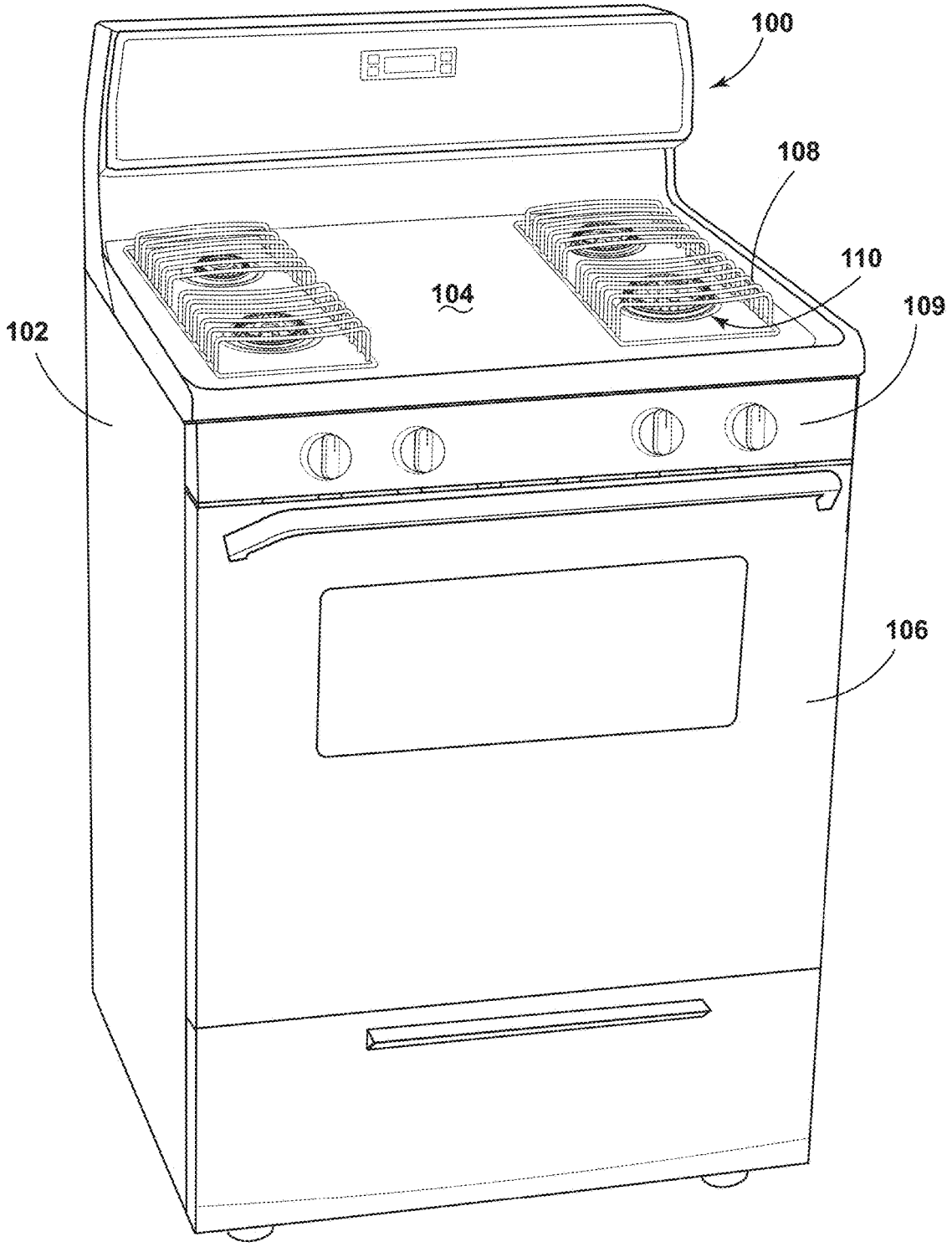
FIG. 2 is a top perspective view of a cooking appliance incorporating the burner base, according to an embodiment of the present disclosure.

The disclosed burner base and burner assembly may be incorporated into a gas cooktop cooking appliance as would be known in the art. FIG. 2 illustrates an exemplary free-standing cooking appliance 100 with which the described embodiments may be incorporated. The illustrated cooking appliance 100 includes an outer body or cabinet 102, a cooktop surface 104, an access door 106 for access to an oven cavity (not shown). Cooktop surface 104 includes a plurality of burner assemblies 110, described in more detail below. Burner assemblies 110 may be enclosed by a cooktop rack 108 for resting a pan thereon, and may be controlled by various burner controls 109. It will be understood, however, that the herein described burner base 10 and burner assembly 110 may be applicable to other types of cooktops, including those which do not form a top portion of a free-standing cooking appliance 100 as shown in FIG. 2, but also those such as built-in cooktops or commercial grade cabinet cooktops. Therefore, cooking appliance 100 is provided by way of illustration only and is not intended to limit the application of the burner base 10 and burner assembly 110 as described herein.

Figure 3:
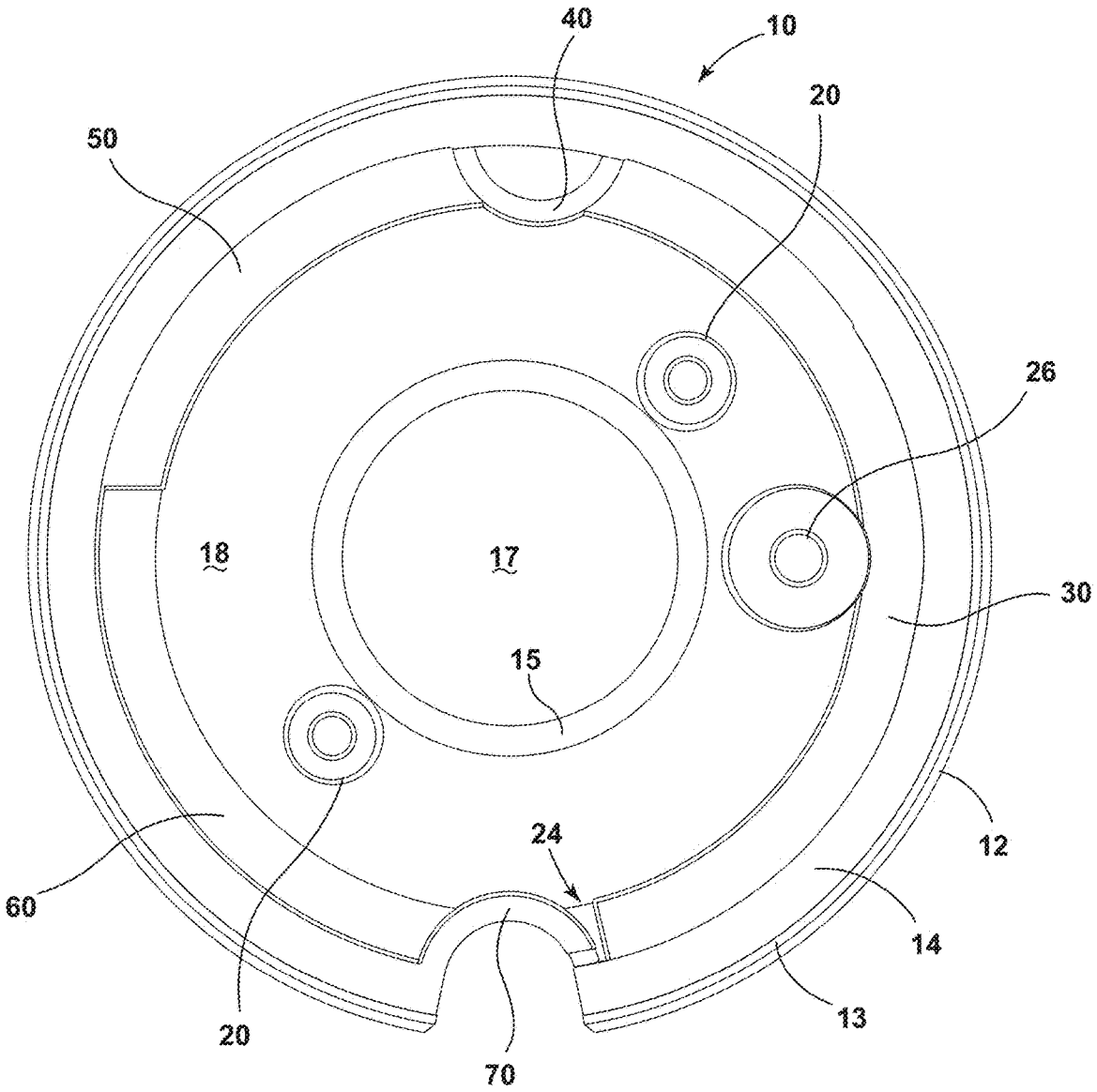
FIG. 3 is a top view of the burner base, according to an embodiment of the present disclosure.

FIGS. 1 and 3 depict a top perspective view and a top view, respectively, of a burner base 10 according to one embodiment described herein. Burner base 10 is configured as a portion of a burner assembly, such as burner assembly 110, which is configured to receive a gas injection for creating a cooking flame for cooking appliance 100. As described in more detail below, and referring to the embodiment depicted in FIGS. 4, 5, and 10, burner base 10 may be configured to receive a burner spreader 80, which together with burner base 10 creates a mixture chamber 112 formed in part by a bottom surface 18 of burner base 10 and a bottom surface 84 of burner spreader 80. Accordingly, because a surface of burner base 10 creates a portion of mixture chamber 112, the structural geometry of burner base 10 may affect the distribution of gas within mixture chamber 112.

In the illustrated embodiment, burner base 10 is configured as a substantially round disc that includes a perimeter edge structure 12 defining a portion of a perimeter of burner assembly 110. Perimeter edge structure 12 includes a top surface 14 as well as a barrier lip 13. Perimeter top surface 14 and barrier lip 13, together with openings 96 (FIG. 10) on bottom surface 84 of burner spreader 80 may serve as the exit structure through which a cooking flame may flow. In the central portion of burner base 10 an opening 17 may be defined with an internal perimeter lip 15. Internal perimeter lip 15, together with internal edge 87 of the bottom surface 84 of burner spreader 80 may create an internal barrier for gas mixture chamber 112.

According to one embodiment, the geometry of burner base 10 within mixture chamber 112 includes a sloped bottom surface 18 that extends from internal perimeter lip 15 down to first barrier structure 30, a second barrier structure 40, a third barrier structure 50, and fourth barrier structure 60. Burner base 10 also includes an ignition barrier structure 70, adjacent to an ignition passage 24. Ignition passage 24 may be coupled to an ignition source for burner assembly 110. For example, a spark may be introduced through ignition passage 24 to ignite gas contained within mixture chamber 112. Burner base 10 may also include one or more fixation apertures 20 for affixing burner base 10 or burner assembly 110 to a cooking appliance 100.

According to aspects of the present disclosure, a burner base may include structural features, geometries, and zones to help distribute the flow of gas within a mixture chamber in a predictable manner to create a more even flame around the associated burner assembly. For example, in some cases, a burner base may include one or more structural zones around a gas ignition port to help distribute the gas being released from the gas ignition port around the entirety of the burner assembly. In at least one case, as shown in the illustrated embodiment, burner base 10 may include at least four different structural zones to enable the distribution of gas. In the illustrated embodiment, burner base 10 includes a first structural zone having a first barrier structure 30, a second structural zone having a second barrier structure 40, a third structural zone having a third barrier structure 50, a fourth structural zone having a fourth barrier structure 60.

Figure 6A:
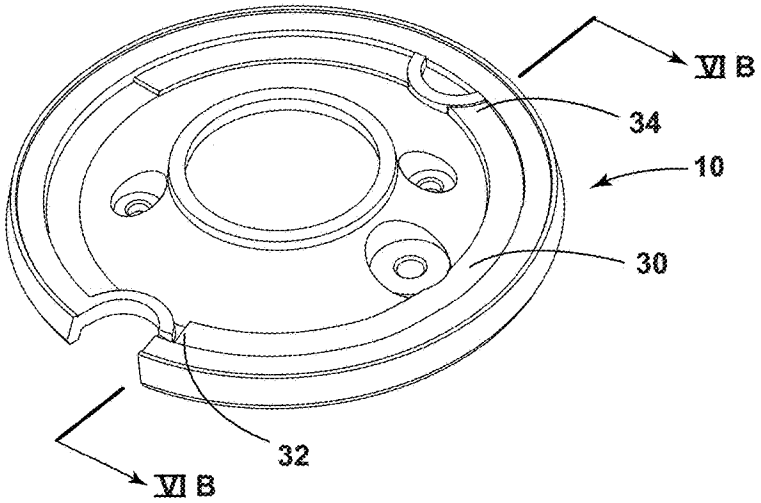
FIGS. 6A and 6B depict a side perspective view and a related cross-sectional view of the burner base, according to an embodiment of the present disclosure.
Figure 6B:
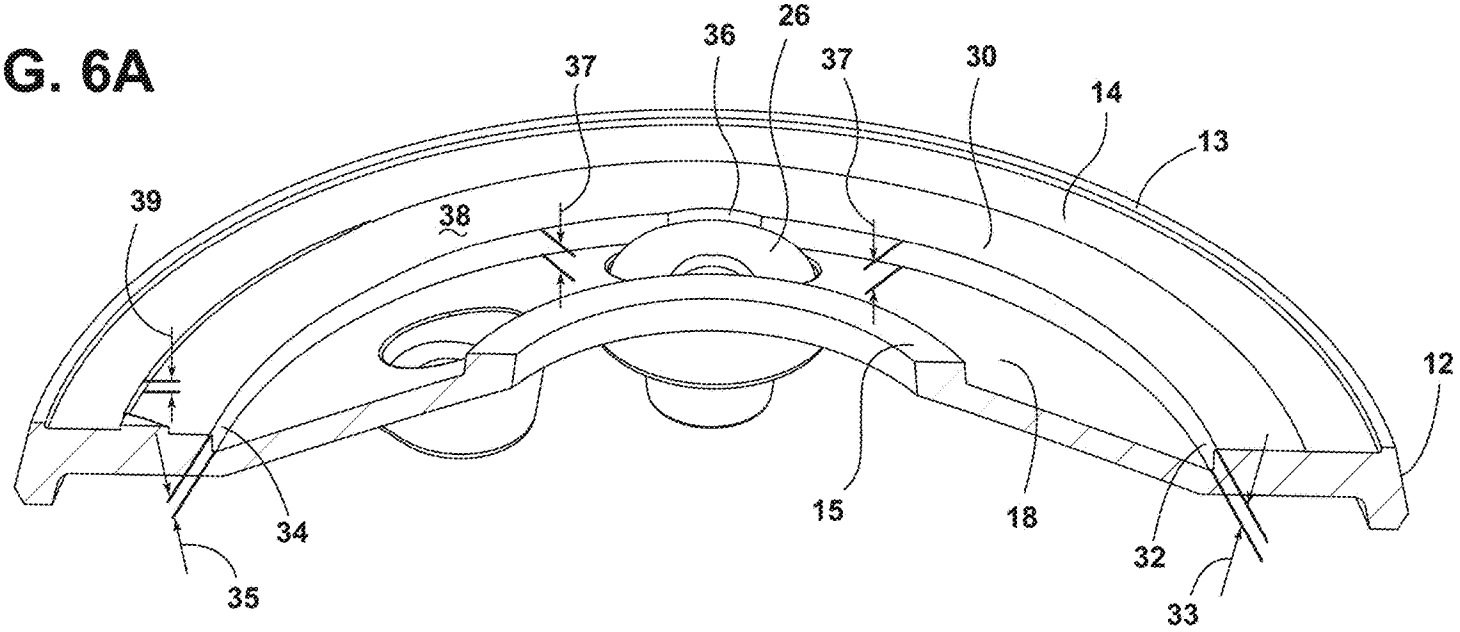

FIGS. 6A and 6B depict a top perspective view and a cross-sectional view, respectively, of a first structural zone having a first barrier structure 30 according to the illustrated embodiment. In particular, FIG. 6B is a top perspective cross-sectional view of first barrier structure 30 as shown across cross-sectional line VI B in FIG. 6A. The geometry of the first structural zone having first barrier structure 30 is situated around gas injection port 26, as shown in detail in FIG. 6B. Specifically, first structural zone includes sloped bottom surface 18 extending, at a high end, from internal perimeter lip 15 down to, and including, a first barrier structure 30 at a low end. As depicted, first barrier structure 30 includes a semi-circular projection above bottom surface 18 that is adjacent to perimeter top surface 14.

As illustrated, first barrier structure 30 includes a first end 32, a second end 34 and a middle section 36. First end 32 is proximate ignition barrier structure 70, and includes a first end height 33 as measured above bottom surface 18. Second end 34 is proximate second barrier structure 40, and includes a second end height 35 as measured above bottom surface 18. Middle section 36 is proximate gas injection port 26 and includes a middle section height 37 as measured above bottom surface 18. First barrier structure 30 may also include a top surface 38 which may be sloped or may be in the same plane as perimeter top surface 14. As illustrated in FIG. 6B, at first end 32, top surface 38 is in the same plane as perimeter top surface 14, and then gradually slopes down toward second end 34 such that there is a height difference at step down 39 between perimeter top surface 14 and top surface 38 at second end 34.

Referring to FIG. 6B, middle section height 37 may be different than first end height 33 and second end height 35. In at least one case, middle section height 37 is taller than first end height 33 as well as second end height 35. In still another case, first barrier structure 30 is symmetric such that the middle section height 37, directly proximate and on both sides of injection port 26, is substantially the same, and first end height 33 is substantially the same as second end height 35. In other cases, however, first barrier structure 30 and its associated heights may vary and not be perfectly symmetric around the entirety of the semi-circle.

Figure 7A:
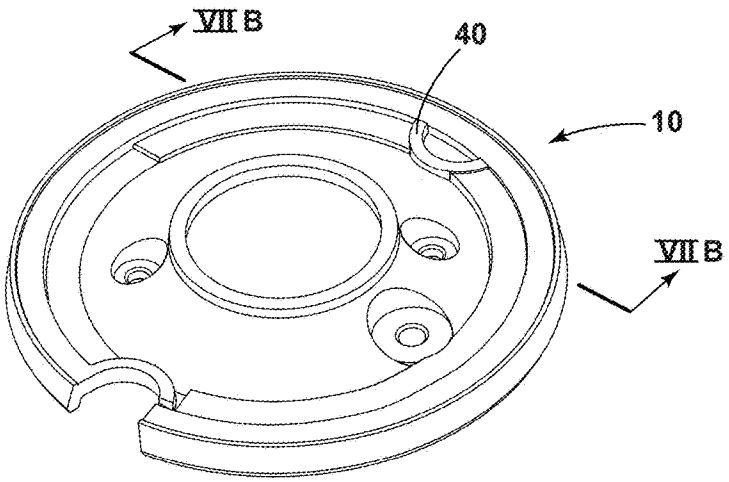
FIGS. 7A and 7B depict another side perspective view and a related cross-sectional view of the burner base, according to an embodiment of the present disclosure.
Figure 7B:
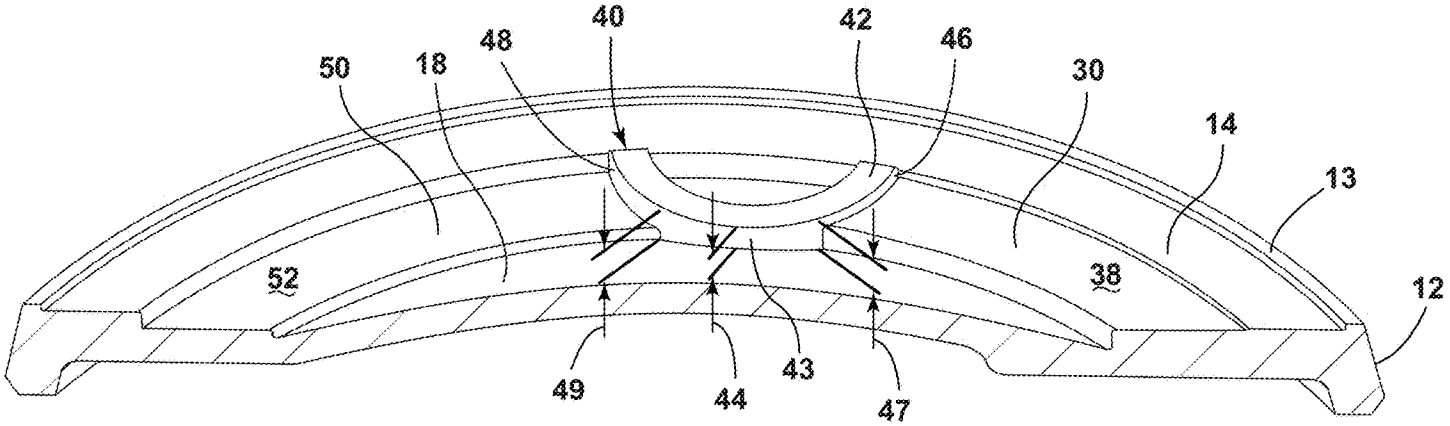

FIGS. 7A and 7B depict a top perspective view and a cross-sectional view, respectively, of a second structural zone having a second barrier structure 40 according to the illustrated embodiment. More specifically, FIG. 7B is a top perspective cross-sectional view of second barrier structure 40 as shown across cross-sectional line VII B in FIG. 7A. Second barrier structure 40 may be located between first barrier structure 30 and third barrier structure 50, and may be diametrically opposite from ignition barrier structure 70. In one embodiment, the geometry of the second structural zone consists of a semi-circular arc structure that rises above bottom surface 18, with a peak or midpoint 43 oriented toward the center of burner base 10, a first end 46 proximate perimeter top surface 14, and a second end 48 proximate perimeter top surface 14.

As shown in detail in the embodiment depicted in FIG. 7B, second barrier structure 40 rises above bottom surface 18 at a plurality of heights. First, second barrier structure 40 defines a midpoint height 44 at midpoint 43 from bottom surface 18 to a top surface 42. Second barrier structure 40 also defines a first interface height 47 and a second interface height 49. First interface height 47 is defined between bottom surface 18 and top surface 42 where second barrier structure 40 interfaces with first barrier structure 30. Second interface height 49 is defined between bottom surface 18 and top surface 42 where second barrier structure 40 interfaces with third barrier structure 50. In some cases midpoint height 44 is different than first interface height 47 and second interface height 49. In at least one embodiment, midpoint height 44 is smaller than first interface height 47 and second interface height 49. In the illustrated embodiment, first interface height 47 and second interface height 49 are equal, and larger, than midpoint height 44. Further, as can be seen in FIG. 7B, in at least one embodiment, second end 48 of second barrier structure 40 rises above a top surface 52 of third barrier structure 50 more than first end 46 of second barrier structure 40 rises above top surface 38 of first barrier structure 30.

Figure 8A:
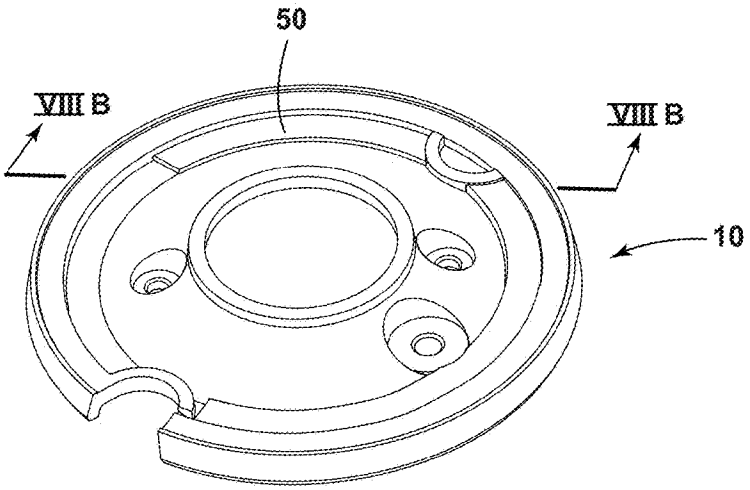
FIGS. 8A and 8B depict another side perspective view and a related cross-sectional view of the burner base, according to an embodiment of the present disclosure.
Figure 8B:
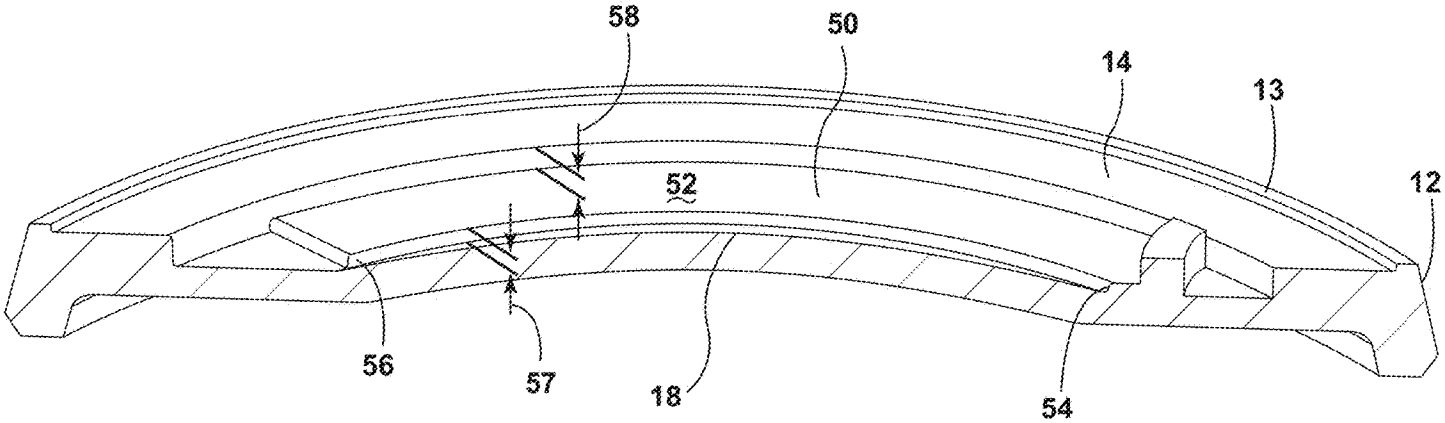

FIGS. 8A and 8B depict a top perspective view and a cross-sectional view, respectively, of a third structural zone having a third barrier structure 50 according to the illustrated embodiment. In particular, FIG. 8B is a top perspective cross-sectional view of third barrier structure 50 as shown across cross-sectional line VIII B in FIG. 8A. The geometry of the third structural zone having third barrier structure 50 is located between second barrier structure 40 and fourth barrier structure 60, along the perimeter of burner base 10. Specifically, third structural zone includes sloped bottom surface 18 extending, at a high end, from internal perimeter lip 15 down to a third barrier structure 50 at a low end. As depicted, third barrier structure 50 includes a semi-circular projection above bottom surface 18 that is adjacent to perimeter edge structure 12 and perimeter top surface 14.

Third barrier structure 50 includes a first end 54 and a second end 56. First end 54 interfaces with second barrier structure 40 and second end 56 interfaces with fourth barrier structure 60. According to the illustrated embodiment, third barrier structure extends above bottom surface 18 at a height 57. Third barrier structure 50 also includes a top surface 52 which may be sloped or may be in the plane that is parallel to perimeter top surface 14. As illustrated in FIG. 8B, top surface 52 is in a plane that is parallel to perimeter top surface 14, but is separated from perimeter top surface 14 by a distance 58.

Referring to FIG. 8B, in the illustrated embodiment, the height above bottom surface 18, i.e. height 57, is consistent along the length of third barrier structure 50. However, in other cases, a height along third barrier structure 50 may vary from the first end 54 to the second end 56 to produce different gas flow patterns within mixture chamber 112.

Figure 9A:
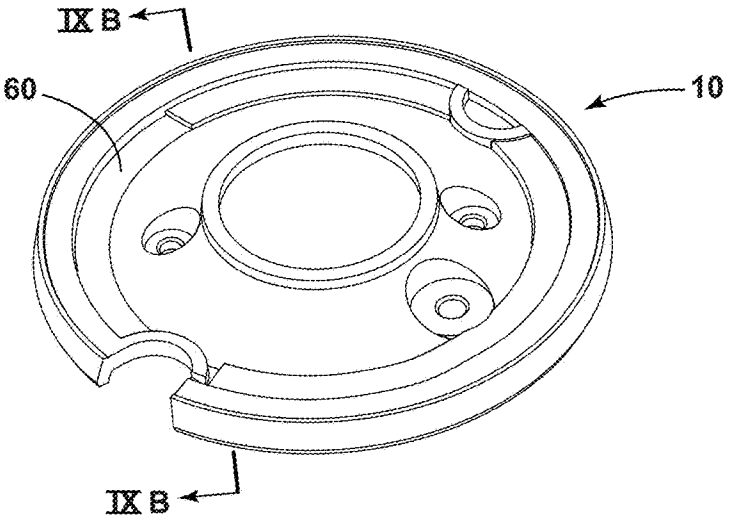
FIGS. 9A and 9B depict yet another side perspective view and a related cross-sectional view of the burner base, according to an embodiment of the present disclosure.
Figure 9B:
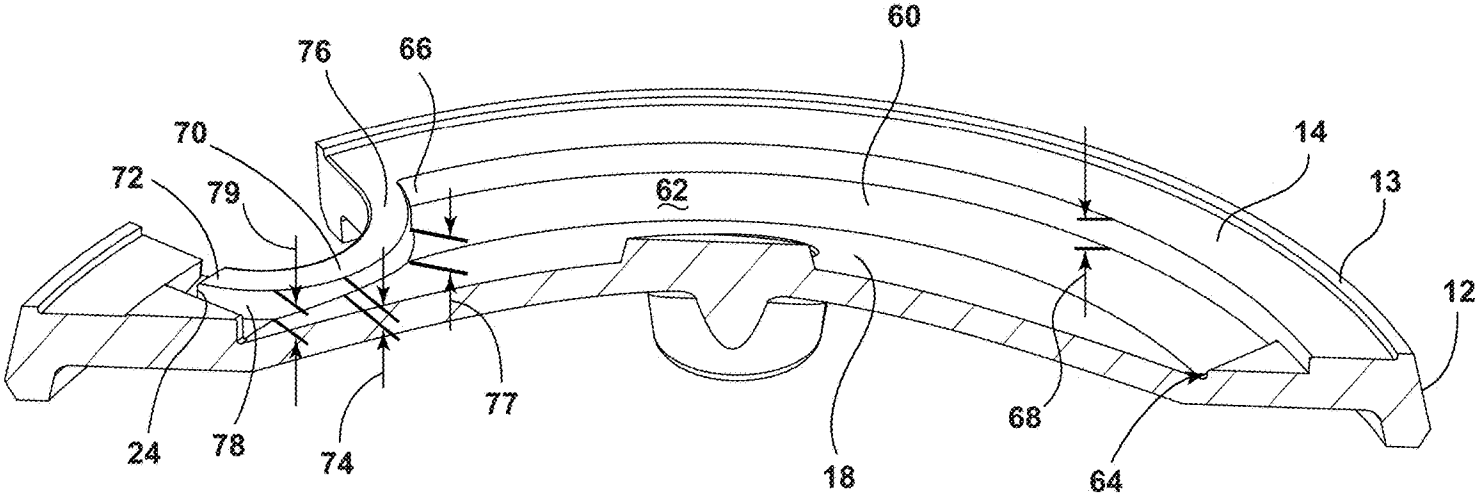

FIGS. 9A and 9B depict a top perspective view and a cross-sectional view, respectively, of a fourth structural zone having a fourth barrier structure 60 according to the illustrated embodiment. In particular, FIG. 9B is a top perspective cross-sectional view of fourth barrier structure 60 as shown across cross-sectional line IX B in FIG. 9A. The geometry of the fourth structural zone having fourth barrier structure 60 is located between third barrier structure 50 and ignition barrier structure 70, along the perimeter of burner base 10. Specifically, fourth structural zone includes sloped bottom surface 18 extending, at a high end, from internal perimeter lip 15 down to fourth barrier structure 60 at a low end. As depicted, fourth barrier structure 60 includes a semi-circular projection area extending away from bottom surface 18 to perimeter edge structure 12.

Fourth barrier structure 60 includes a first end 64 and a second end 66. First end 64 interfaces with third barrier structure 50 and second end 66 interfaces with ignition barrier structure 70. According to the illustrated embodiment, fourth barrier structure 60 extends away from bottom surface 18, without introducing a height to the fourth structural zone. Fourth barrier structure 60 also includes a top surface 62 which may be sloped or may be in a plane that is parallel to perimeter top surface 14. As illustrated in FIG. 9B, top surface 62 is in a plane that is parallel to perimeter top surface 14, but is separated from perimeter top surface 14 by a distance 68.

FIG. 9B also depicts ignition barrier structure 70, which is adjacent to fourth barrier structure 60 and ignition passage 24, which allows an ignition to be introduced into mixture chamber 112. In the illustrated embodiment, as discussed above, ignition barrier structure 70 may be located diametrically opposite from second barrier structure 40. Similar to the geometry of the second structural zone, ignition barrier structure 70 consists of a semi-circular arc structure that rises above bottom surface 18, with a peak or midpoint 73 oriented toward the center of burner base 10, a first end 76 proximate perimeter top surface 14, and a second end 78 proximate ignition passage 24.

Ignition barrier structure 70 rises above bottom surface 18 at a plurality of heights. First, ignition barrier structure 70 defines a midpoint height 74 at midpoint 73 from bottom surface 18 to a top surface 72. Ignition barrier structure 70 also defines a first end height 77 and a second end height 79. First end height 77 is defined between bottom surface 18 and top surface 72 where ignition barrier structure 70 interfaces with fourth barrier structure 60. Second end height 79 is defined between bottom surface 18 and top surface 72 where ignition barrier structure 70 interfaces with ignition passage 24. In some cases midpoint height 74 is different than first end height 77 and second end height 79. In at least one embodiment, midpoint height 74 is smaller than first end height 77 and second end height 79. In the illustrated embodiment, first end height 77 and second end height 79 are equal, and larger, than midpoint height 74. Further, as can be seen in FIG. 9B, in at least one embodiment, second end height 79 of ignition barrier structure 70 is substantially the same as the first end height 33 of first barrier structure 30. In other words, top surface 72 is in substantially the same plane as top surface 38 of first barrier structure 30 at the first end 32. In addition, according to the illustrated embodiment, at first end 76, top surface 72 of ignition barrier structure 70 is substantially higher than top surface 62 of fourth barrier structure 60. Further, top surface 72 is in substantially the same plane as perimeter top surface 14.

Figure 4:
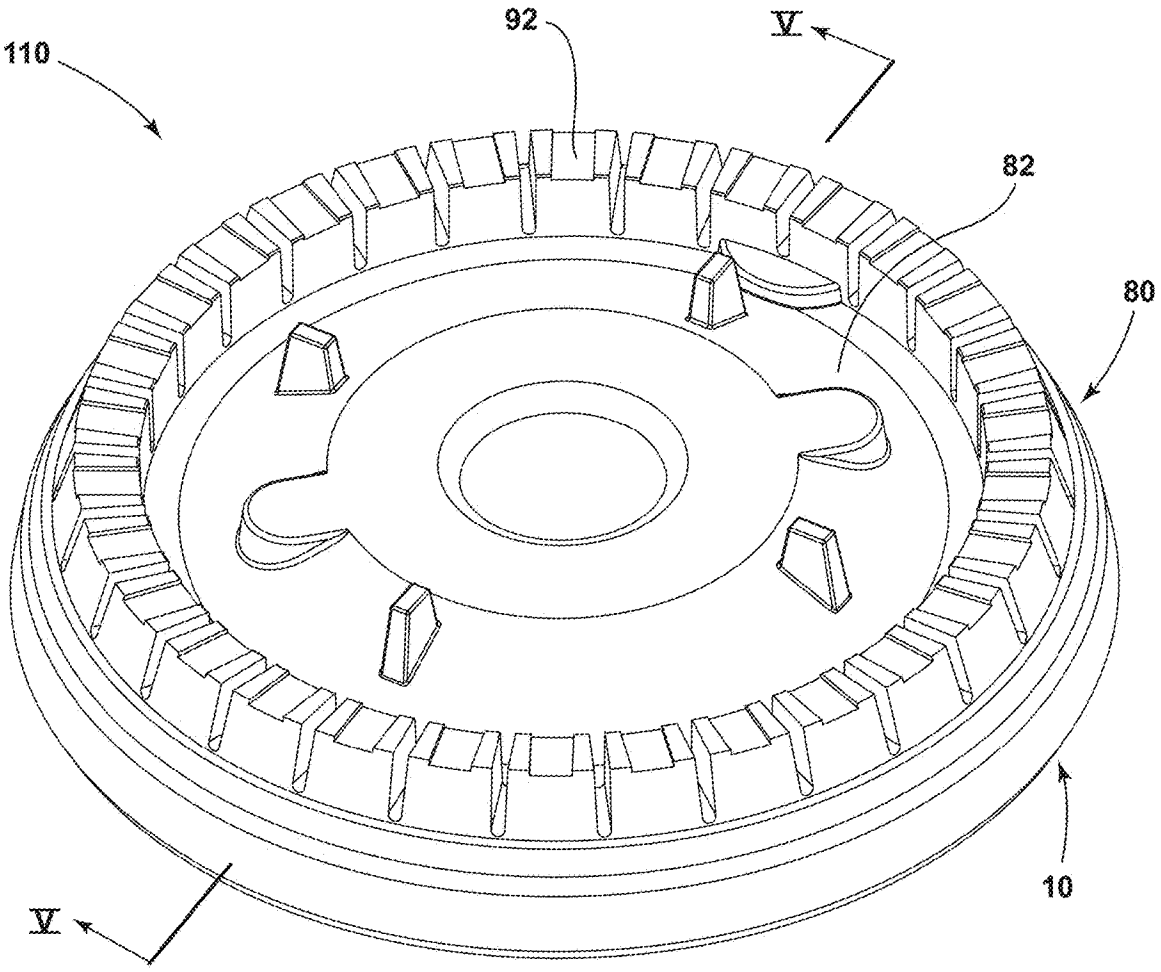
FIG. 4 is a top perspective view of a burner base assembly, according to an embodiment of the present disclosure.
Figure 5:
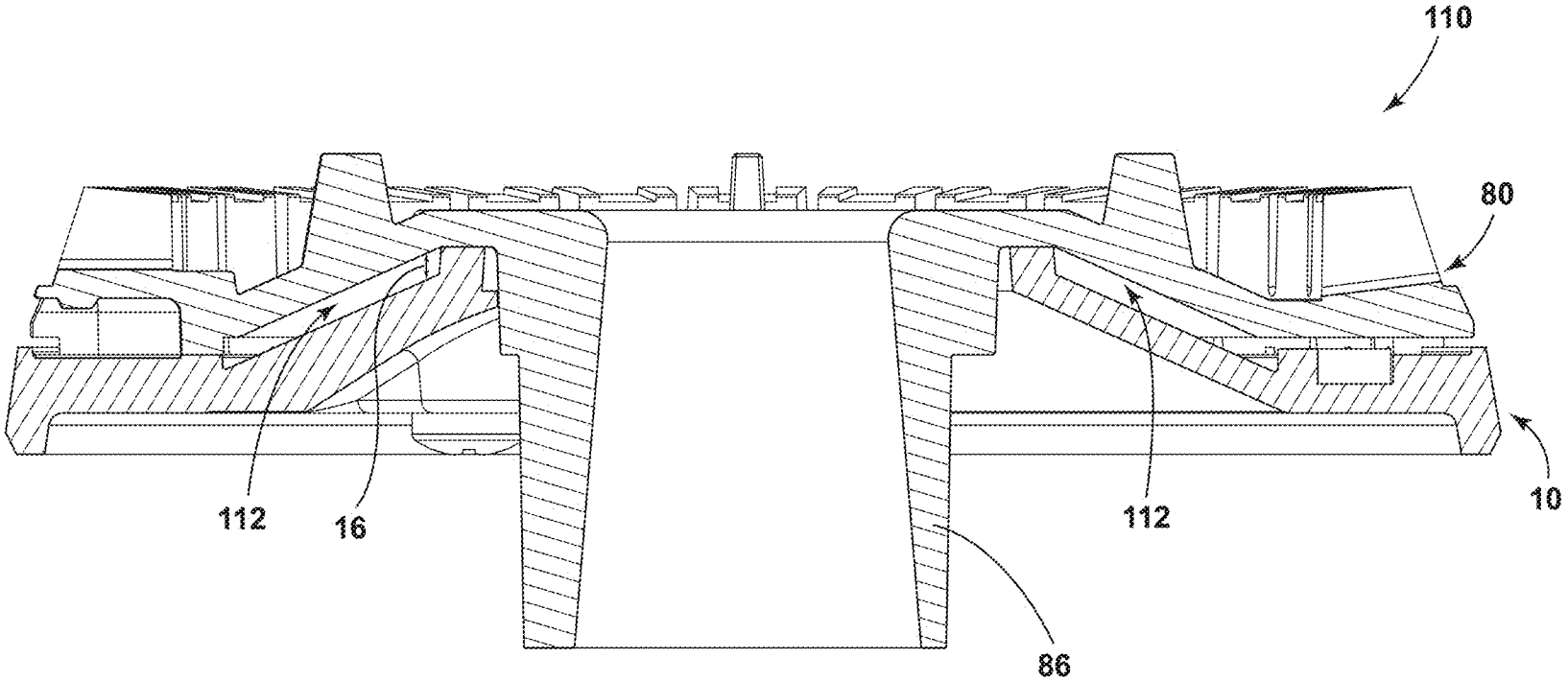
FIG. 5 is a cross-sectional view of the burner base assembly, according to an embodiment of the present disclosure.
Figure 10:
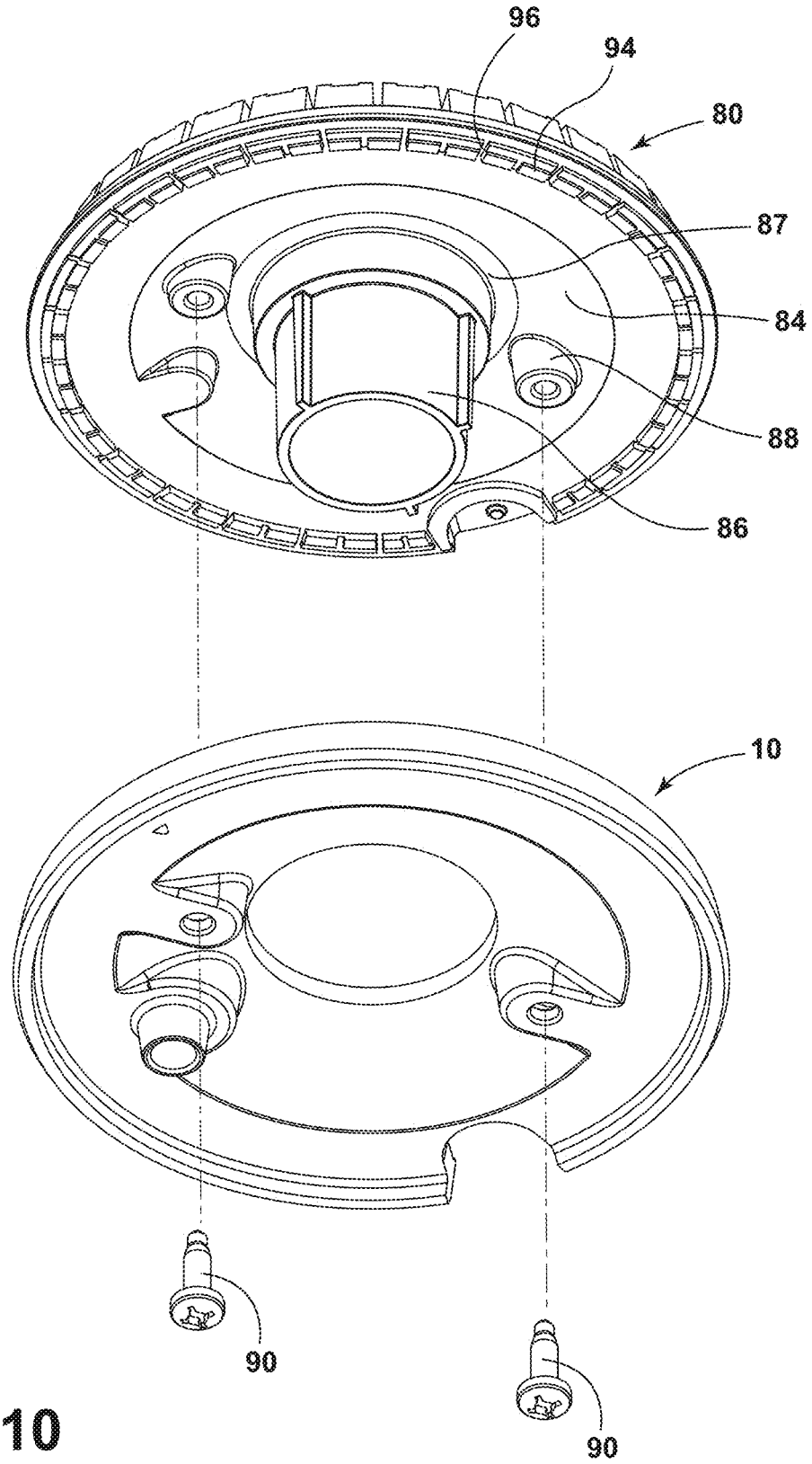
FIG. 10 depicts an exploded bottom perspective view of a burner assembly according to an embodiment described herein.

FIGS. 4, 5, and 10 depict burner spreader 80 of burner assembly 110 according to the illustrated embodiment. Burner spreader 80 includes a top surface 82 and a bottom surface 84 (FIG. 10). Top surface 82 includes a plurality of projections 92 that coincide with, and may be offset from, plurality of ridges 94 on the bottom surface 84. As can be seen in FIGS. 5 and 10, burner spreader 80 includes a central portion 86 that extends downward and is received within opening 17 of burner base 10. Accordingly, bottom surface 84 of burner spreader 80 and internal perimeter lip 15 create an upper barrier having a height 16 of mixture chamber 112. Ridges 94 of burner spreader 80 may further align with perimeter top surface 14 of burner base 10, creating openings 96 for gas and a cooking flame to be distributed around burner assembly 110. Burner spreader 80 further includes one or more securement apertures 88 that align with fixation apertures 20 of burner base 10 for securing burner assembly 110 to a cooktop appliance 100 or other cooktop surface. Burner assembly 110 may be secured with fasteners 90 as shown in FIG. 10 or other securement methods as would be known in the art.

When burner base 10 is coupled with a cover such as burner spreader 80, the various surface geometries of the burner base, together with the bottom surface 84 of burner spreader 80, may define the overall surface structure of mixture chamber 112. In operation, the overall surface structure of mixture chamber 112 may facilitate the flow of gas inside burner mixture chamber 112, enabling a cooking flame to exit the entire circular path of burner assembly 110. More specifically, the variable geometries of the first structural zone, the second structural zone, the third structural zone, and the fourth structural zone, as described herein, may create pressure differentials within mixture chamber 112 that effect the velocity and stability of the gas around the burner assembly 110. Thus, when gas is injected through injection port 26, and ignited by an ignition introduced through ignition passage 24, the pressure differentials created by the structural zones can serve to move the injected gas, and thus the cooking flame, consistently and stably around burner assembly 110.

As described above, the first barrier structure 30 of the first structural zone, the second barrier structure 40 of the second structural zone, the third barrier structure 50 of the third structural zone, the fourth barrier structure 60 of the fourth structural zone, as well as the ignition barrier structure 70, each comprise distinct surface geometries. Accordingly, in at least one embodiment, the radial cross-sectional area of the mixture chamber varies between the structural zones, and in some cases, varies along a single structural zone.

For example, in the illustrated embodiment, the variable height of first barrier structure 30 creates a variable radial cross-sectional area within mixture chamber 112 that causes gas injected through injection port 26 to be drawn away from middle section 36 and around the circle of burner base 10. In particular, because the middle section 36 of the first barrier structure 30 is taller (middle section height 37) than the first end 32 and the second end 34 (first end height 33 and second end height 35), a radial cross-sectional area of the middle section of the first structural zone is smaller than the radial cross-sectional areas at the ends of the first structural zone. Accordingly, the change in area, moving from the middle section, or proximate middle section 36, out to the ends, proximate first end 32 and the second end 34, creates a pressure differential. In at least one embodiment, due to the increase in the area of the mixture chamber 112, the pressure drops from the middle section 36 to the first end 32, and from the middle section to the second end 34. The pressure drop can cause the velocity of the gas to increase and the gas to be drawn from the gas injection port 26 and middle section 36 toward first end 32 and second end 34.

As previously discussed, second barrier structure 40 is geometrically similar to ignition barrier structure 70, which is located diametrically opposite from second barrier structure 40. Accordingly, second barrier structure 40 allows for the flow of gas at the first end 32 of first barrier structure 30 to mimic the flow of gas at the second end 34 of first barrier structure 30, creating a symmetrical flow at these locations within mixture chamber 112. Thus, in at least one embodiment, as the gas is moved toward the first end 32 and the second end 34 due to the geometry of the first structural zone, the symmetric structures of second barrier structure 40 and ignition barrier structure 70 help to ensure the symmetry and stability of the gas and cooking flame at the diametrically opposite areas of mixture chamber 112.

Third barrier structure 50, having a uniform height 57, creates a uniform geometry around the third structural zone as shown in FIG. 8B. This uniform geometry of mixture chamber 112 helps to create an even pressure in the zone opposite injection port 26 and reduces the volume of mixture chamber 112 as compared to the volumetric capacity at second end 34 of the first structural zone. Accordingly, the third barrier structure 50 creates yet another pressure differential, or drop in pressure, that causes gas to continue flowing around mixture chamber 112 from injection port 26 toward structural zone three and structural zone four, creating a steady, stable cooking flame around burner assembly 110.

It will be understood by one having ordinary skill in the art that construction of the described device and other components is not limited to any specific material. Other exemplary embodiments of the device disclosed herein may be formed from a wide variety of materials, unless described otherwise herein.

It is also important to note that the construction and arrangement of the various aspects of the burner base as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.)

without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It is also to be understood that variations and modifications can be made on the aforementioned structures and methods without departing from the concepts of the present device. Further, it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

The invention claimed is:

1. A burner base, comprising:

an internal perimeter lip;

a perimeter edge defining a barrier lip disposed radially outward of the internal perimeter lip;

a bottom surface configured to be coupled with a burner spreader and extending outwardly from the internal perimeter lip toward the barrier lip, a gas inlet being defined in the bottom surface;

a first barrier structure disposed along the perimeter edge adjacent the gas inlet and having a middle section height above the bottom surface that is greater than an end height above the bottom surface;

a second barrier structure circumferentially adjacent to the first barrier structure on a common circumference and defining an arc raised from the bottom surface that is inwardly directed from the barrier lip toward the internal perimeter lip; and a third barrier structure extending circumferentially away from the second barrier structure on the common circumference and defining a constant height along a length of the third barrier structure.

2. The burner base of claim 1, wherein the first barrier structure extends circumferentially and the end height of the first barrier structure includes a first end height above the bottom surface and a second end height, the second end height being defined by a downward slope from the middle section height, wherein the first end height, the second end height, and the middle section height are circumferentially spaced along the first barrier structure.

3. The burner base of claim 1, wherein the first barrier structure has a top surface that slopes toward an end of the first barrier structure.

4. The burner base of claim 1, wherein the second barrier structure defines a first interface height raised from the bottom surface adjacent the second barrier structure defined between the bottom surface of the burner base and a top surface of the perimeter edge.

5. The burner base of claim 1, wherein the third barrier structure is radially disposed above the bottom surface at a uniform height.

6. The burner base of claim 1, further including:

a first structural zone that includes the first barrier structure;

a second structural zone that includes the second barrier structure;

a third structural zone that includes the third barrier structure;

wherein:

the bottom surface slopes downwardly from the internal perimeter lip toward the perimeter edge; and the first, second, and third structural zones are each partially defined by the bottom surface of the burner base.

7. The burner base of claim 1, further including:

an ignition barrier structure defined by a top surface of the perimeter edge and having an arc structure raised from the bottom surface and extending radially inwardly with a peak oriented toward the internal perimeter lip; and wherein the arc structure defines an ignition passage opening into the bottom surface.

8. The burner base of claim 6, wherein a gas mixture chamber is at least partially defined by the bottom surface of the burner base and slopes upwardly from the common circumference towards the internal perimeter lip.

9. The burner base of claim 8, wherein the internal perimeter lip is centrally positioned within the gas mixture chamber.

10. The burner base of claim 6, wherein the first, second, and third structural zones are disposed circumferentially adjacent to the bottom surface and the perimeter edge, each of the first, second, and third structural zones extending circumferentially away from the gas inlet.

11. The burner base of claim 8, wherein the first, second, and third structural zones, along with the bottom surface, the internal perimeter lip, and the perimeter edge cause a symmetrical flow of gas away from the gas inlet within the gas mixture chamber.

12. The burner base of claim 1, wherein the gas inlet is located between the common circumference and the internal perimeter lip.

13. The burner base of claim 12, wherein the end height of the first barrier structure includes a first end height above the bottom surface and a second end height, the second end height being defined by a downward slope from the middle section height, wherein the middle section height is different than the first end height and the second end height.

* * * * *